US008297618B2

(12) United States Patent
Bianco

(10) Patent No.: US 8,297,618 B2
(45) Date of Patent: Oct. 30, 2012

(54) PUZZLE WITH PROBLEM-SOLUTION FEATURES ALIGNING PUZZLE PIECES WITH A CORRESPONDING SUPPORT BOARD LOCATION

(76) Inventor: Ronald Bianco, Laguna Beach, CA (US)

( * ) Notice: Subject to any disclaimer, the term of this patent is extended or adjusted under 35 U.S.C. 154(b) by 245 days.

(21) Appl. No.: 12/814,386

(22) Filed: Jun. 11, 2010

(65) Prior Publication Data

US 2010/0327527 A1 Dec. 30, 2010

Related U.S. Application Data

(60) Provisional application No. 61/220,535, filed on Jun. 25, 2009.

(51) Int. Cl.
*A63F 9/10* (2006.01)

(52) U.S. Cl. ..... 273/157 R

(58) Field of Classification Search ..... 273/153 R, 273/157 R, 156; 463/1, 9
See application file for complete search history.

(56) References Cited

U.S. PATENT DOCUMENTS

| | | | | | |
|---|---|---|---|---|---|
| 3,937,472 | A * | 2/1976 | Rice | 273/157 R |
| 4,076,253 | A * | 2/1978 | Eriksen | 273/157 R |
| 4,586,714 | A * | 5/1986 | Lenkoff et al. | 273/157 R |
| 4,741,534 | A * | 5/1988 | Rogahn | 273/157 R |
| 4,838,551 | A * | 6/1989 | Volpert | 273/157 R |
| 5,743,741 | A * | 4/1998 | Fife | 434/205 |
| 6,062,864 | A * | 5/2000 | Rood | 434/191 |
| 6,619,661 | B1 * | 9/2003 | Collins | 273/157 R |
| 7,631,870 | B1 * | 12/2009 | Bennett | 273/157 R |
| 2003/0234488 | A1 * | 12/2003 | Povitz | 273/156 |
| 2008/0136099 | A1 * | 6/2008 | Frost | 273/157 R |
| 2010/0327527 | A1 * | 12/2010 | Bianco | 273/157 R |
| 2011/0148040 | A1 * | 6/2011 | Bianco | 273/157 R |

* cited by examiner

*Primary Examiner* — Raleigh W. Chiu
(74) *Attorney, Agent, or Firm* — Knobbe, Martens, Olson & Bear LLP

(57) ABSTRACT

A puzzle is described that enhances the educational and enjoyment aspect of assembling the puzzle by providing a plurality of problem-solution pairs that serve to direct and/or confirm that puzzle pieces are positioned correctly. One half of the problem-solution pairs may be placed on the back of individual puzzle pieces with the other half on intended adjacent pieces or other they may be placed on a base board with the complementary half on the back of the pieces intended to be placed above the corresponding problem-solution pair. The puzzle is so designed that it may be configured as a 2-dimensional puzzle or a 3-dimensional puzzle and may be provided in electronic form if so desired.

14 Claims, 4 Drawing Sheets

PUZZLE WITH PROBLEM-SOLUTION FEATURES ALIGNING PUZZLE PIECES WITH A CORRESPONDING SUPPORT BOARD LOCATION

BACKGROUND

The present invention relates generally to games in which engaging pieces may be placed together to form a picture, and more specifically where the game is a puzzle designed to permit alternative methods of forming the picture through challenges beyond the visual.

Historically, puzzles are wonderful vehicles for entertainment that are designed such that the resulting picture drives the challenge. In other words, the desire to build the picture piece by piece is based typically upon a copy provided with the puzzle and the visual challenge of fitting each piece appropriately in its respective position.

There may certainly be educational aspects to puzzles that entail physical and mental aspects. However, the mental aspects could be enhanced beyond mere visual challenges by not only creating a "positional" relationship between adjacent puzzle pieces that correspond to a properly completed image on the top surface, but also by creating a "problem-solution" relationship between either the puzzle piece and its corresponding position below, or between a puzzle piece and its adjacent piece or pieces.

One example of the latter puzzle is shown U.S. Pat. No. 4,076,253 to Eriksen. In that reference, a problem-solution relationship is disclosed among paired adjacent puzzle pieces. The puzzle may be completed by adjoining pieces whose sides correspond to a problem-solution pair. As described in the '253 patent to Eriksen, the complementary counterpart edges are of suitable shape whereby they are intended to be placed into coextensive engagement to form a predetermined figure or symbol. A more desirable and more challenging arrangement is contemplated by the present invention.

SUMMARY

In one embodiment of the present invention, a puzzle comprises a plurality of pieces that when properly aligned complete a picture on one side of the puzzle. In this embodiment, the puzzle has a complementary base or board upon which the puzzle pieces can reside. Traditionally, the back of each puzzle piece would be blank. In this embodiment, however, the back of the puzzle has one of either a problem or solution provided thereon, with a corresponding solution or problem, respectively, at a corresponding place on the base where that particular puzzle piece is supposed to be positioned, or on the back of what should be adjacently-positioned pieces. In the former case, a single problem-solution pair can be created. In the latter case, multiple problem-solution pairs are provided, so that adjacent pieces may be appropriately oriented.

In the single problem-solution pair arrangement, either the problem or the solution can be provided on the back of a puzzle piece, and its corresponding solution or problem provided on the puzzle base. In the multiple problem-solution pair arrangement, it is envisioned that each piece would have multiple problems and/or solutions along each "side" of the puzzle piece back that would have a corresponding set of solutions and/or problems on the back of adjacent puzzle piece backs. As the problems and solutions are matched, i.e., when the "problem" piece is placed on the correct "solution" location on the puzzle board, a part of the picture puzzle is completed.

In some embodiments of this invention, some or all of the puzzle pieces are uniformly shaped and, therefore, could be interconnected anywhere within the puzzle with any other puzzle piece. They should be engaging in a way that stabilizes the puzzle as it develops, but the pieces need not interlock specifically. Curvilinear or rectilinear sides may be configured so that adjacent pieces fit nicely together, but do not necessarily interlock. In some cases, the puzzle pieces could comprise lock and key (or, e.g., tongue and groover) arrangements such as those found in many traditional puzzles.

In other embodiments, some of all of the puzzle pieces comprise a variety of shapes and configurations, but the picture is more complex such that it does not permit easy location of the proper position for a particular piece within the greater picture; e.g., a monotone feature spread over a plurality of pieces. In yet other embodiments, a combination of such shapes and configurations is contemplated, designed to address different challenge levels. As can be appreciated from the embodiments of the present invention, the method for determining the proper placement of the puzzle pieces is more difficult than with a traditional puzzle, enhancing the "challenge" to the puzzle.

BRIEF DESCRIPTION OF THE FIGURES

The detailed description of some embodiments of the invention will be is made below with reference to the accompanying figures, wherein like numerals represent corresponding parts of the figures.

DETAILED DESCRIPTION OF CERTAIN EMBODIMENTS

Figure 1:
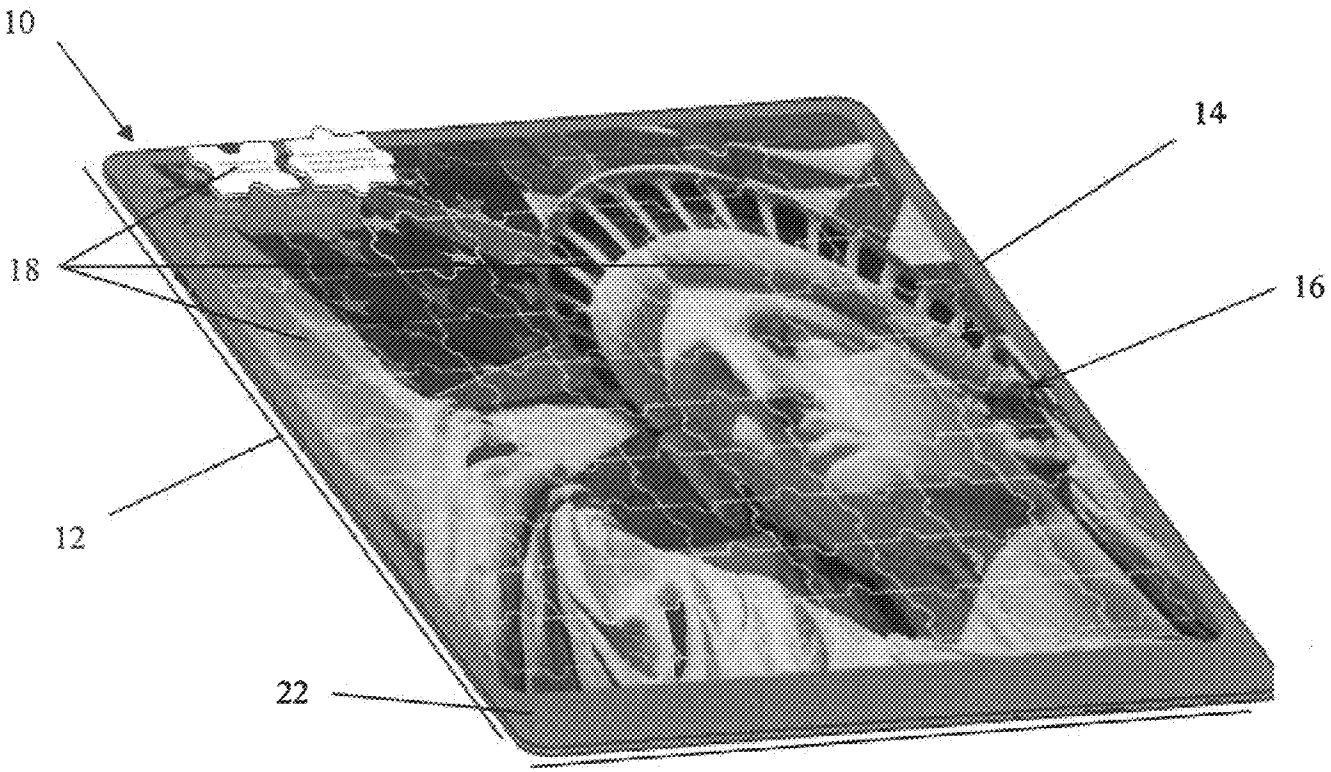
FIG. 1 shows a schematic perspective view of one embodiment of a puzzle.
Figure 2:
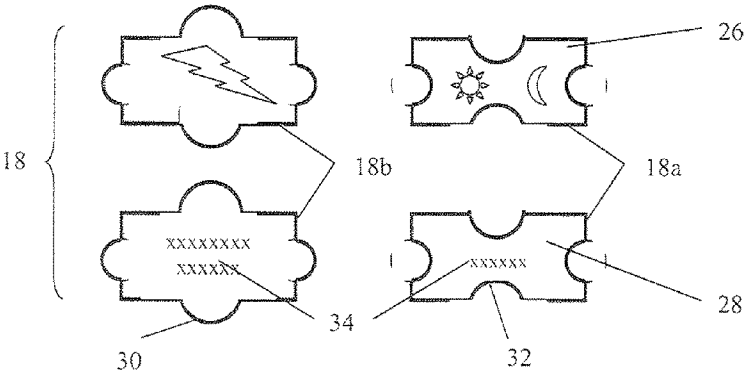
FIG. 2 shows a schematic view of both sides of exemplary pieces from the embodiment of FIG. 1.
Figure 3:
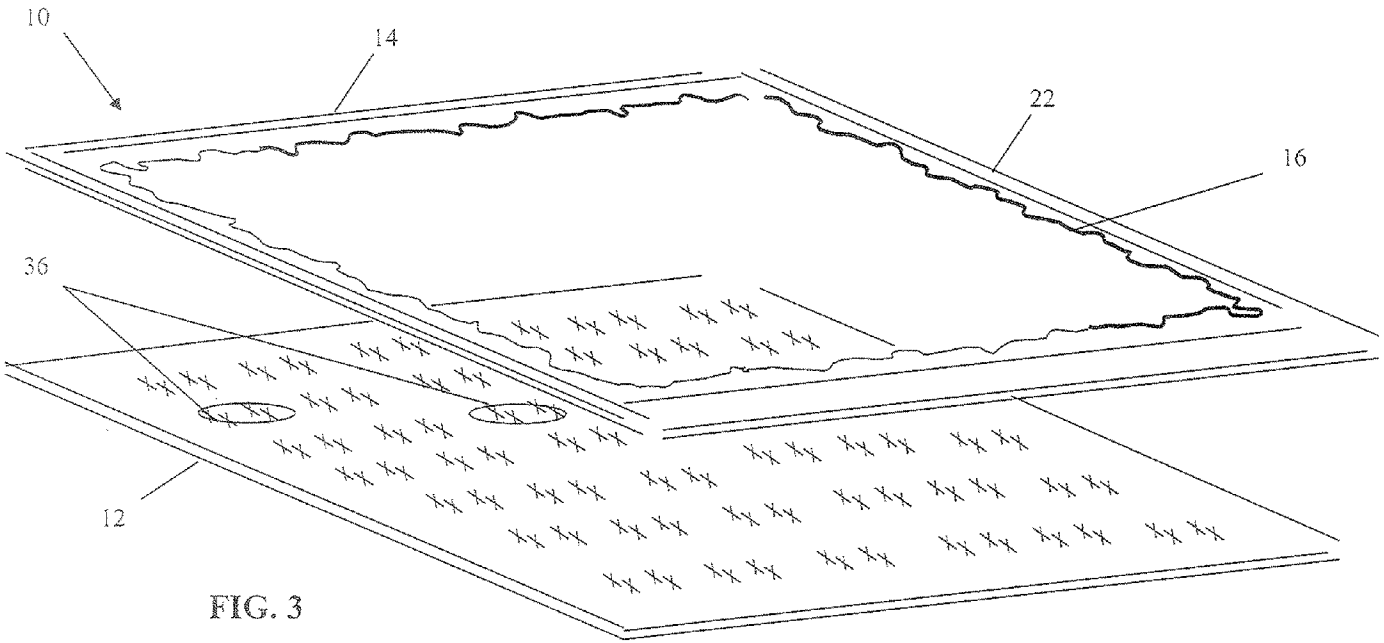
FIG. 3 shows a schematic view of the puzzle of FIG. 1 in which the puzzle is shown comprising a top panel of image puzzle pieces (partially cut away) and a lower panel shown by example only comprising a plurality of textual displays that reflect one half of a plurality of problem-solution pairs, where the other half of the pairs are not shown but may be displayed on the back surface of the image puzzle pieces.

By way of example, FIGS. 1 through 3 show one embodiment of the inventive puzzle described and claimed herein. One embodiment comprises a puzzle 10 comprising a bottom panel 12 (shown more completely in FIG. 3) and a top or upper panel 14. The top panel 14 comprises a top surface displaying an image of any desired presentation, where the image comprises a plurality of discrete pieces 18 bounded by a frame 22. In FIG. 1, two of the discrete puzzle pieces 18 are removed, and are described in more detail below. A frame 22 is optional as the puzzle pieces may be configured so as to functionally display an image securely without the need for a frame. Although not critical, an outer edge of the frame 22 may be flush with an outer edge the base panel 12, as shown.

Referring to FIGS. 2 and 3, a feature of the inventive puzzles comprises corresponding problem-solution pairs that are displayed in a way so as to drive, to some intellectual and/or entertaining degree, progressive assembly of the puzzle. In one embodiment, and by example the embodiment illustrated in FIGS. 1 through 3, one half of the problem-solution pairs are displayed on the based panel 12 and the other half are displayed on the bottom surface of the image puzzle pieces 18. In FIG. 2 specifically, two puzzle pieces 18*a*, 18*b* are shown. In this embodiment, the pieces 18 comprises an upper surface 26 displaying part of a desired image 16 and a lower surface 28 displaying one half (by example a question in text form 34) of a problem-solution pair.

In the example shown in FIG. 2, the puzzle pieces 18*a*, 18*b* have shapes that permit complimentary engagement with each other when positioned adjacent, where projecting members 30 of piece 18*b* conform to concave portions 32 of piece 18*a*. Such a configuration permits complimentary engagement, but not necessarily interlocking engagement, so other configurations are contemplated for adjacent puzzle pieces 18. Of course, the pieces 18 may be of a configuration that permits interlocking engagement between adjacent pieces. There are a number of possible interlocking configurations, both in the particular configuration and profile of the puzzle piece as well as mechanical means that serve to sustain engagement.

Referring to FIG. 3, the top panel 14 comprises the frame 22 with most of the interior image 16 cut away to expose the bottom panel 12. The display on the bottom panel, by example in this embodiment, is a plurality of one half of the problem-solution pairs. In one embodiment, the one half of the problem-solution pair may be a question that corresponds to an answer on the back or lower surface of a puzzle piece 18 intended to be placed over that question. It could be instead be an answer corresponding to a puzzle piece having a corresponding question. But, as discussed herein, it could be any combination of intellectual and/or entertaining pairs designed to create a corresponding position for a puzzle piece 18 and a placement on the base panel 12. In all cases, it is desired that the result of proper placement is an image 16 viewable by the user, as is illustrated by example in FIG. 1. In carrying out the puzzle, a user looks an a question (either on the base panel 12 or a puzzle piece 18) and tried to match it with the corresponding answer (vice versa) and places the piece on the bottom panel 12 accordingly.

If desired, the bottom panel 12 may have defined raised borders to locate the appropriate puzzle piece in a somewhat restrained (i.e., not-so-easily movable) position. The bottom panel may simply present a flat smooth surface as well. It is contemplated that in another embodiment, there is no corresponding pair halves on the base panel 12, but rather the pair halves are found on the bottom surface of adjacent puzzle pieces. In this case, the user does not need a bottom panel and may build the puzzle on any appropriately flat surface. The user simply tries to match puzzle pieces having corresponding halves of the problem-solution pair to determine which pieces are to be placed adjacent each other. The orientation of one puzzle piece to another may be determined by having multiple problem-solution pairs on the back of a single puzzle piece, with each half corresponding to a different adjacent puzzle piece. For example, for puzzles having a generally grid pattern arrangement of puzzle pieces, an interior puzzle piece would likely have four adjacent pieces (i.e., North, South, East, West). In that case, such interior piece might have a different problem-solution pair half along each of the four back side edges of the puzzle piece so that when the pairs are properly matched, the interior piece is appropriately oriented.

For example, one problem-solution pair may match a puzzle piece with a particular location on the base panel 12, but the viewable image is such that it could be placed in more than one orientation. Imagine a skyline image with a fair amount of blue sky. The puzzle pieces that make up the blue sky might be oriented in a number of positions and still present a blue partial image that fits within the overall puzzle. But the image could be sufficiently abstract in design that the orientation of the piece mattered, but it could still be difficult to assess the proper orientation by merely looking at the image face of puzzle piece. The further challenge is then to orient the puzzle piece using a second or even third set of problem-solution pairs presented. One half of the problem-solution pairs may be placed along one edge of the back of one puzzle piece, and the corresponding other half may be placed along one edge of the back of another puzzle piece so that the edges are placed adjacent to each other.

It should be noted that one advantageous feature of presenting problem-solution pairs where one-half of the pair is on a base or bottom panel and the corresponding other half is on the appropriate puzzle piece is that the bottom panel may be replaced with another panel that presents different problem-solution pair halves that still correspond. It can be appreciated that an "answer" can correspond with a variety of different questions. For example, if the answer in a problem-solution pair were a particular year, numerous events may have occurred in that year such that each event presents a different question half of the problem-solution pair that corresponds to that answer. The same is true of countries, or persons, or almost any answer that reflects multi-faceted aspects. Thus, some embodiments contemplated herein include a source of alternative base panels that can be interchanged to add a sense of novelty to the puzzle building experience, and enhances the educational aspect as well. Such a source might be a plurality of hard copy sheets that can serve as the base panel, or electronic storage media from which alternative base panel sheets can be printed out.

It is contemplated that the subject matter for the problem-solution pairs can comprise a variety of topics and grade levels, but could be related to standards-based test curriculum for different subjects by grade level (e.g.: forth grade U.S. history, second grade mathematics, third grade natural science). If desired, the picture created by the proper alignment of the pieces could be an image or multiple images related to the theme of the problem-solution pairs. Such challenging puzzles not only provide an entertaining past time, but can reinforce early learning and improve test taking skills by offering a multiple-choice answer field that can be narrowed by a process of elimination (e.g. dates, people, places, events) as well as other test taking skill methods.

In one embodiment of the present invention, the challenge can be further enhanced by adding a temporal aspect. For example, a time keeping device can be provided, whether integrated into the puzzle base or not, to determine elapsed time required to complete the puzzle and a signaling device to indicate when the time to complete the puzzle has expired.

Certain embodiments may also comprise a system employing a signaling feedback loop for indicating when the appropriate solution has been matched to a particular problem. Such feedback loop may comprise electronically-based sensors on the base that interface with a receiver on the corresponding puzzle piece designed to be placed on or adjacent the sensor.

It should be appreciated that some embodiments, such as that shown in FIGS. 1 through 3 may be configured in a flat arrangement, but could also take on three-dimensional arrangements as well. Indeed, the resulting three-dimensional puzzle could resemble an identifiable item associated with the theme of the problem-solution pairs. For example, the problem-solution pairs could be geographical in nature, with the resulting puzzle forming a globe, or a continent. Another example might be where the problem-solution pairs are cultural in nature, maybe associated with a particular country, with the resulting puzzle forming a famous icon associated with that culture or country (e.g., Eiffel Tower, Leaning Tower of Pisa, etc.)

Although not shown, it is contemplated that the puzzle base may comprise a geometric configuration in which the outside surface displays a plurality of one-half of the problem-solution pairs. For example, the base may be configured in a semi-spherical shape, although a variety of other possibilities in configuration are contemplated. The base may be further configured to permit corresponding pieces bearing the other half of the problem-solution pair to reside on the base in a manner so as not to fall off. The adjacent puzzle pieces may also be interlocking to further enhance structural integrity of the puzzle. It is contemplated that the bottom of the three-dimensional base have a surface sufficiently strong to withstand the weight of the completed puzzle on a table or floor or other supporting surface. It is also contemplated that the interlocking puzzle piece configuration serve to support the completed puzzle to some degree, if not completely, where, in one embodiment, it is required that the puzzle be built from the ground up so to speak, with the higher pieces supported by the lower pieces.

For embodiments having a three-dimensional configuration, arrangements and configurations are possible. For example, in another three-dimensional embodiment, the puzzle comprises a plurality of three-dimensional geometric components or modules that are configured to be placed adjacent to each other as defined by corresponding problem-solution pairs. As with the two-dimensional arrangement, one half of the problem-solution pairs can reside on a base panel upon which the modules can be placed to form an image, or one half of the problem-solution pairs can reside on a side of the geometric modules that face adjacent modules, or a combination of both, as referenced above in Paragraph [0020], and explained further below in the context of a three-dimensional embodiment.

Figure 4:
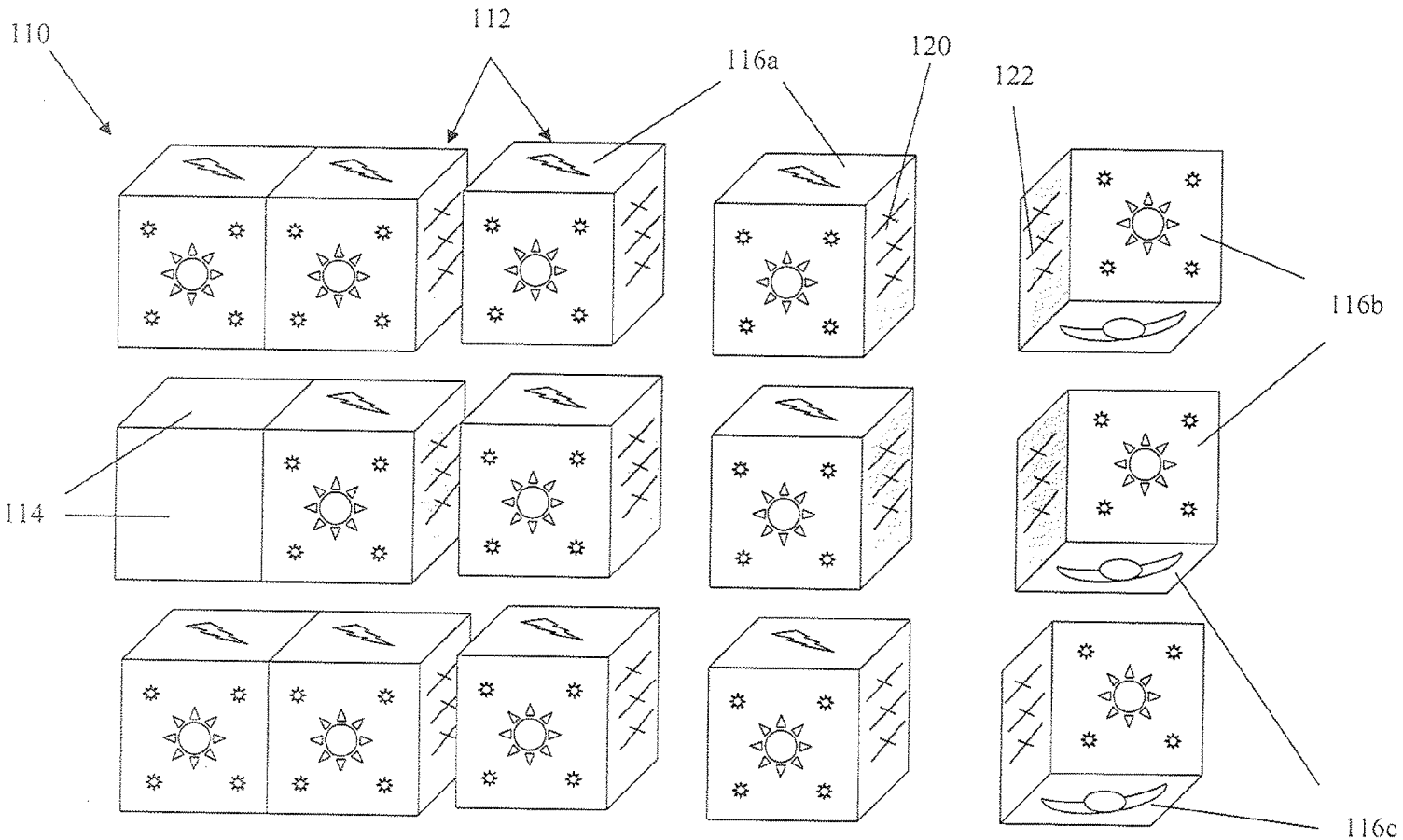
FIG. 4 shows a schematic view of another embodiment of a puzzle comprising a three-dimensional configuration, in which this particular embodiment comprises a plurality of cube-shaped modules, with some of the cube surfaces displaying images and other surfaces of cubes displaying one half of a problem-solution pair.

In one example, the three-dimensional geometric components comprise discrete cubes, each having the normal six sides, although other geometric configurations would be acceptable as well. Referring to FIG. 4, one embodiment of a three-dimensional puzzle 110 comprises a plurality of cube members or pieces 112, each having six sides 114. In one arrangement, three of the cube piece sides 114 comprises parts of images 116*a*, 116*b* and 116*c*, and the other three cube piece sides 114 comprising halves of problem-solution pairs 120, 122. For example, assuming all cube pieces are oriented similarly (i.e., having a top, front, bottom, back and two sides—left and right—surfaces), the top surface 116*a* of each cube 112 may comprise a single image, with each cube surface forming a part of the image in a puzzle-like arrangement. Similarly, the front surface 116*b* of each cube 112 may comprise a single but different image, and the bottom surface 116*c* comprising yet a third single but different image. Depending upon how the problem-solution pairs are arranged or defined, it may be desired for the user to form one of the three images or another.

Figure 5:
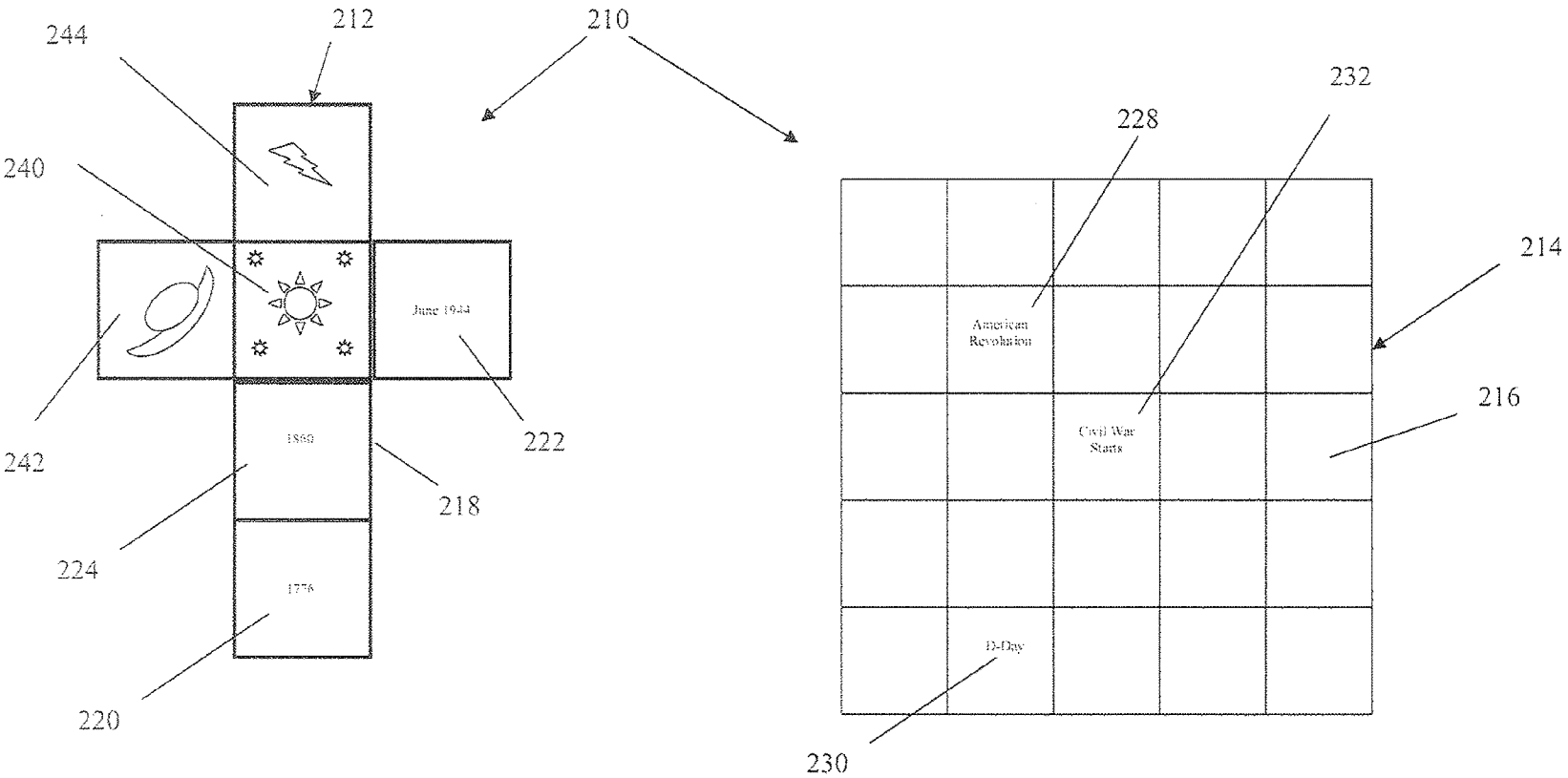
FIG. 5 shows a schematic view of another embodiment of the three-dimensional cube-shaped modular puzzle of FIG. 4.

Referring to FIG. 5, another embodiment of the three-dimensional cube-shaped puzzle of FIG. 4 may be explained with additional particularity. The three-dimensional puzzle 210 comprises a plurality of modules 212 (only one cube-shaped module is shown) and a base or bottom panel 214 for placement of the modules 212 thereupon. The bottom panel 214 comprises a plurality of module positions 216 indicative of where individual modules are intended to be placed. Although this particular embodiment shows a grid arrangement, other arrangements, whether geometrical or fanciful, are contemplated. The cube-shaped module 212 comprises six surfaces 218, at some of which comprise either one-half of a problem-solution pair or part of an image. In this particular embodiment, the module 212 comprises three problem-solution pair halves 220, 222, 224, each indicating—for example—a year in which a noteworthy event occurred. The year of surface 220 is intended to correspond with module position 228 on the base panel 214. Likewise, surface 222 of the cube-shaped module corresponds to the module position 230 and surface 224 corresponds to position 232.

As is shown in FIG. 5, each module presents portions of three possible images, with the particular desired image being presented based upon which problem-solution pair is matched. So for this example, when surface 220 is placed on corresponding module position 228, partial viewable image 240 is presented outwardly. Likewise, when module surface 222 is placed on corresponding module position 230, partial viewable image 242 is presented outwardly When module surface 224 is placed on corresponding module position 232, partial viewable image 2444 is presented outwardly. This arrangement permits the possibility of multiple puzzles using the same game components. It should be understood that each module would present different problem-solution pair halves so that the appropriate module surface 218 of module 212 is placed on the appropriate module position 216 of base panel 214. But as alluded to above, the orientation of the module might be further restricted based upon a second or third problem-solution pair presented by adjacent surfaces of adjacent cube-shaped modules (although not shown particularly in FIG. 5).

Of course, with such a three-dimensional concept, the individual members or modules of the three-dimensional puzzle may comprise other geometrical shapes that permit adjacent placement to form a coherent viewable image, even an image that is not in a single flat plane as in the embodiment of FIG. 4. It is contemplated, for example, that the individual puzzle pieces or members may comprise tetrahedrals, with a pointed end all facing toward a center so that the base of each tetrahedral faces outwardly in a spherical arrangement. Depending upon which sides of the tetrahedrals comprise which halves of the problem-solution pairs, the image displayed may be different in each case.

Regardless of whether the puzzle is two-dimensional or three-dimensional, it can be appreciated that a problem-solution pair has almost infinite possibilities, not only in subject matter, but in format and presentation. For example, instead of questions and answers enabling the proper placement of the puzzle pieces on the puzzle board, at least some embodiments may comprise pieces that have pictures, symbols, numbers and the like, whereby such indicia can be matched to a corresponding picture, number or symbol on the puzzle board or adjacent piece. Such embodiments do not require the ability to read and can be used to teach and practice pre-school skills without parental participation. Ideal subject matter for this embodiment may include: alphabet, counting, colors, opposites, telling time, money and sequencing.

It should be noted that the desired puzzle need not require engagement of all of the provided plurality of puzzle pieces. It could be that there are duplicate pieces in size, shape and configuration where alternative solutions are provided to enhance the challenge so that each "solution" piece might fit within its corresponding "problem" location, but the resulting image is incorrect. Other variety of outcomes is also contemplated that enhance the mental challenge to the puzzle game.

Yet another set of embodiments of the present invention comprises a puzzle presented entirely in graphic form on a computer, accessible through the internet or from software usable on a computer. In other words, a virtual puzzle is contemplated whereby the individual pieces, their surfaces with either partial images and/or problem-solution pair halves and/or a base also with problem-solution pair halves are digitally rendered via software suitable for presentation on an electronic device, such as—but not limited to—a computer, a personal digital assistant, cellphone, XBox, DS, iPod, iPad, or any other electronic device capable of operating and/or storing software designed to display a puzzle as described herein, whereby the user may build the puzzle as described herein and enjoy the problem-solution aspects thereof, such that the surfaces, images and problem-solution pairs are presented visually for user interface and manipulation. Indeed, the puzzle games, as with many electronic games, may be accessible remotely from a publicly accessible storage media, e.g., server, so that an individual user might enjoy the game, or multiple remote users might do so together. Indeed, the variety of possible puzzle piece configurations and problem-solution pairs becomes almost unlimited, with the user having the capability to vary the puzzle between a two-dimensional and three-dimensional form, vary the problem-solution pairs, vary the image that is completed by assembling the puzzle pieces, and even varying the geometric form of the three-dimensional modules that are placed together to form the desired image.

What is claimed is:

1. A puzzle game comprising a plurality of engaging pieces, at least some of which have a proper position within the puzzle when completed, such that when all of the at least some pieces are properly in place, a desired image appears, a plurality of said at least some puzzle pieces having a first and second surface, the first surface comprising a visual image that is part of a larger image formed from the assembly said at least some puzzle pieces, the second surface comprising a display of a first set of information that challenges the user to find a corresponding second set of information at a desired location for the puzzle piece, the first and second set of information comprising a problem-solution pair, whereby when the problem-solution pairs are properly matched, the larger image is properly displayed.

2. The puzzle of claim 1 further comprising a puzzle base for supporting the puzzle, the base comprising the second set of information in an arrangement that permits proper pairing of the problem-solution pairs to result in the desired image.

3. The puzzle of claim 2, wherein a portion of the second set of information is on the base and a portion of the second set of information is one or more puzzle pieces designed to be positioned adjacent to the puzzle piece having the corresponding first set of information.

4. The puzzle of claim 2, wherein the base comprises a three-dimensional configuration.

5. The puzzle of claim 1, wherein the resulting puzzle comprises a three-dimensional shape.

6. The puzzle of claim 5, wherein the puzzle comprises a plurality of discrete three-dimensional geometrical modules, a substantial number of the modules having at least one side comprising one half of a problem-solution pair, and at least one side comprising part of an image.

7. The puzzle of claim 6, further comprising a base panel configured to permit placement of the plurality of modules in an arrangement that results in a discernable viewable image.

8. The puzzle of claim 7, wherein the base panel comprises the other half of the problem-solution pair presented on the module in an arrangement that permits proper pairing of the problem-solution pairs to result in the desired image.

9. The puzzle of claim 1, wherein the engaging puzzle pieces are interlocking.

10. The puzzle of claim 1, wherein the second set of information resides on one or more puzzle pieces designed to be positioned adjacent to the puzzle piece having the corresponding first set of information.

11. The puzzle of claim 1 further comprising feedback indicating proper placement of puzzle pieces.

12. The puzzle of claim 1 further comprising a timer settable to one of a number of times for completing a portion of the entirety of the puzzle.

13. A virtual puzzle game comprising the features set forth in claim 1, wherein the surfaces, images and problem-solution pairs are presented visually for user interface and manipulation.

14. The virtual puzzle game of claim 13, wherein the puzzle is configured to permit a user to substitute one set of problem-solution pairs for an alternative set of problem-solution pairs.

* * * * *